United States Patent [19]

Spinner

[11] Patent Number: 4,875,027

[45] Date of Patent: Oct. 17, 1989

[54] WAVEGUIDE TWIST

[76] Inventor: Georg Spinner, Am Eichberg 12/8152, Feldkirchen-Westerham, Fed. Rep. of Germany

[21] Appl. No.: 247,916

[22] Filed: Sep. 22, 1988

[30] Foreign Application Priority Data

Oct. 2, 1987 [DE] Fed. Rep. of Germany ..... 3733397

[51] Int. Cl.[4] ..... H01P 1/02

[52] U.S. Cl. ..... 333/254; 333/257

[58] Field of Search ..... 333/21 A, 249, 256, 333/257, 261, 254

[56] References Cited

U.S. PATENT DOCUMENTS 3,138,769 6/1964 DeWitt ..... 333/257

3,786,378 1/1974 Liguori ..... 333/257

*Primary Examiner*—Paul Gensler

*Attorney, Agent, or Firm*—Henry M. Feiereisen

[57] ABSTRACT

A waveguide twist includes at least three waveguide sections which are connected to each other and rotatable about their longitudinal axis usually by a same angle. Each waveguide section with the exception of the first waveguide section and the last waveguide section supports externally a lever which has two axial ends engaging in grooves of adjoining waveguide sections so as to be longitudinally displaceable to allow distribution of the total angle of rotation over the waveguide sections.

13 Claims, 4 Drawing Sheets

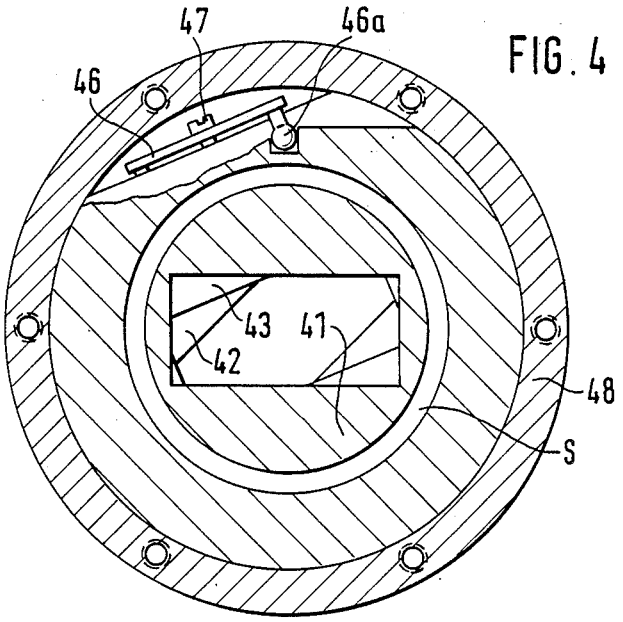
FIG. 4
FIG. 5
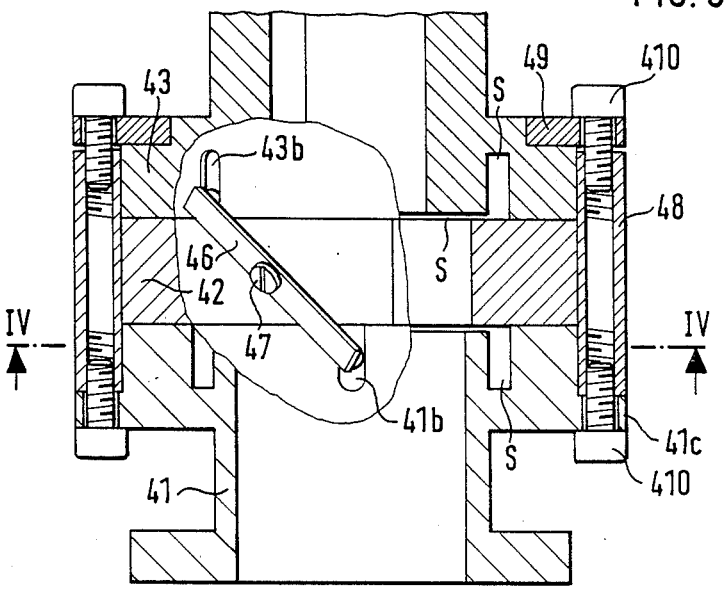

WAVEGUIDE TWIST

BACKGROUND OF THE INVENTION

The present invention refers to a waveguide twist, and in particular to a waveguide twist with at least three waveguide sections connected to each other and rotatable relative to each other about their longitudinal axis.

Such a waveguide twist (twisted waveguide section) is required for connecting rectangular waveguides with misaligned transverse axes and is known from Meinke/-Gundlach "Taschenbuch der Hochfrequenztechnik", Springer Verlag, 2nd edition, page 401; however, this publication does not disclose any constructive measures which allow to set the angle of twist to a desired value in a simple manner and to attain a uniform distribution of the angle of twist over all waveguide sections so as to ensure a rotation of the waveguide sections relative to each other by a same angle.

It is known to connect waveguide sections via gear transmissions in order to distribute the total angle of rotation equally over the waveguide sections (see e.g. U.S. Pat. No. 2,947,955). The use of such gear transmissions is, however, complicated and is justified only in those rare cases which require a frequent modification of the angle of twist e.g. for test purposes. In general, however, such waveguide twists are adjusted only once to the desired angle of twist, that is during the initial installation of the waveguide train.

SUMMARY OF THE INVENTION

It is thus a principal object of the present invention to provide an improved waveguide twist obviating the afore-stated drawbacks.

This object and others which will become apparent herenafter are attained in accordance with the present invention by providing externally each waveguide section with the exception of the first waveguide section and the last waveguide section with a lever which is rotatably supported about an axis perpendicular to the longitudinal waveguide axis and has two axial ends which engage in grooves of adjoining waveguide sections for longitudinal displacement.

Preferably, when providing a waveguide twist with more than three waveguide sections, the levers of successive waveguide sections are offset to each other by 180°.

Through the provision of such a lever arrangement for connecting the waveguide sections, the total angle of rotation is distributed over the individual waveguide sections, and after setting the angle of twist, the waveguide sections arranged between the stationary first and last waveguide sections are prevented from further rotation. When designing a waveguide twist in accordance with the invention with three waveguide sections, the maximal adjustable angle of rotation can be e.g. +45° without the reflection factor exceeding 5%. Providing a waveguide twist in accordance with the invention with five waveguide sections, an angle of rotation of maximum +95° is attainable with a reflection factor of below 10%.

The lever arrangement thus allows in simple manner the distribution of the total angle of rotation over the partial angles by which successive waveguide sections are twisted relative to each other.

Suitably, each lever is rotatably supported by a bolt which is arranged on the respective waveguide section perpendicular to the longitudinal waveguide axis. In order to compensate a misalignment in height which necessarily occurs between respective axial ends of the levers and during increasing rotation of the waveguide section, the lever ends are suitably provided as pins in form of guide heads, preferably spherical heads, which engage in the grooves. Evidently, the rotational support of the lever and the guidance of the respective lever ends in the grooves should be without play as much as possible in order to attain e.g. the usually uniform distribution of the angle of rotation over the individual waveguide sections.

According to a further feature of the present invention, the first and last waveguide sections are braced to each other by screws to improve the galvanic contact-making of the waveguide sections and to prevent the waveguide sections from being displaced relative to each other perpendicularly to the longitudinal waveguide axis. Instead of the galvanic contact-making, the waveguide sections may certainly be connected via contactless choke joints.

Preferably, the waveguide sections are received in a common housing which not only serves as rotational support and guidance for the waveguide sections but also improves the rf-tightness.

In general, it is desired to distribute the total angle of rotation evenly over all waveguide sections so as to rotate the latter by a same partial angle. However, by providing each lever with lever arms of varying length, the present invention allows also the distribution of the total angle of rotation over varying partial angles in order to attain a further decrease of the reflection factor or an increase of the band width in case the reflection factor is given. The same result can be achieved by providing the grooves for the lever ends slantingly to the longitudinal waveguide axis rather than parallel thereto. The band width may also be increased by differently dimensioning the electric length of the waveguide sections aligned between the first and last waveguide sections.

BRIEF DESCRIPTION OF THE DRAWING

The above and other objects, features and advantages of the present invention will now be described in more detail with reference to the accompanying drawing in which:

FIG. 4 is a cross sectional view of a second embodiment of a waveguide twist according to the invention taken along the line IV—IV in FIG. 5;

FIG. 5 is a longitudinal section of the waveguide twist of FIG. 4;

DETAILED DESCRIPTION OF PREFERRED EMBODIMENTS

Figure 1:
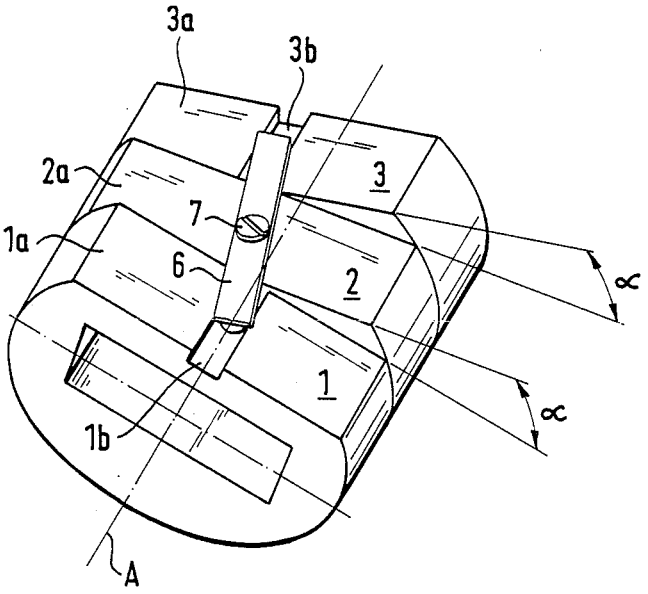
FIG. 1 is a perspective principal view of a waveguide twist in accordance with the invention.

Referring now to the drawing, and in particular to FIG. 1, there is shown a perspective principal view of a waveguide twist according to the invention. The waveguide twist includes three rectangular waveguide sections 1, 2 and 3 which are each of cylindrical shape over a major portion of their circumference with a flat surface area 1*a*, 2*a*, 3*a*. Adjoining waveguide sections 1 and 2; 2 and 3 are rotated relative to each other about the waveguide axis A by a same angle $\alpha$.

The progressive angular displacement of the waveguide sections 1, 2, 3 and thus the uniform distribution of the total twist angle $2\alpha$ is attained by a lever 6 which is rotatably supported by a bolt 7 at a central location of the flat surface 2*a* and engages with its axial ends in guide grooves 1*b*, 3*b* of the waveguide sections 1, 3, with the grooves 1*b*, 3*b* extending parallel to the longitudinal waveguide axis A.

Figure 2:
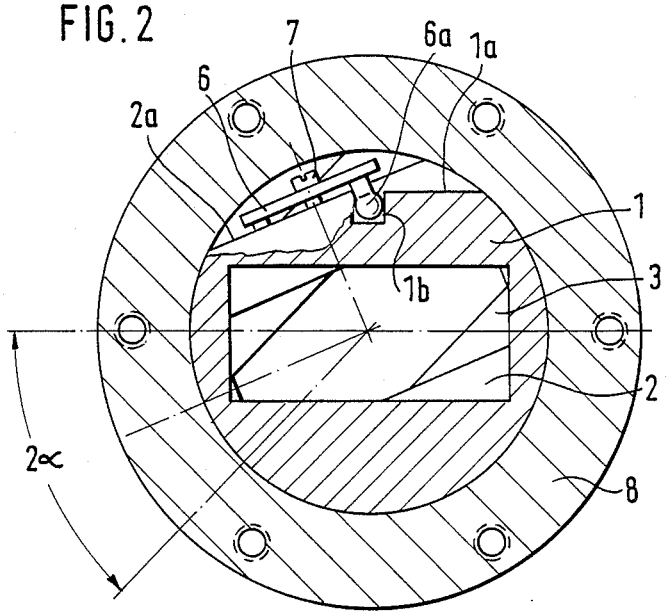
FIG. 2 is a cross sectional view of a first embodiment of a waveguide twist according to the invention taken along the line II—II in FIG. 3.
Figure 3:
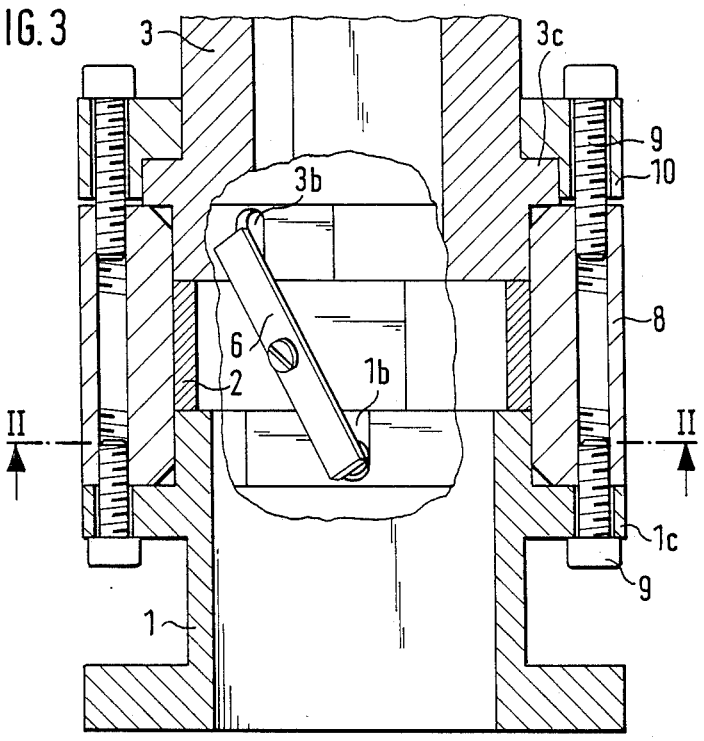
FIG. 3 is a longitudinal section of the waveguide twist of FIG. 2.

Turning now to FIGS. 2 and 3 which show a first embodiment of a waveguide twist according to the invention and in correspondence to the principal design as described with reference to FIG. 1. As can be seen in particular by the longitudinal section of FIG. 3, the waveguide sections 1, 3 are partly received in an outer housing 8 while the waveguide section 2 is completely accommodated therein. The housing 8 extends externally between an outwardly directed shoulder 3*c* of the waveguide section 3 and an outwardly directed shoulder 1*c* of the waveguide section 1. At the upper end of the housing 8 is a flange 10 which is inwardly directed and bears against the upper side of the shoulder 3*c*. The flange 10 is secured to the housing 8 by a bolt 9. In like manner the shoulder 1*c* of the waveguide section 1 is secured to the housing 8 by a bolt 9. The housing 8 serves as a rotational support for the waveguide sections 1, 2, 3 and simultaneously ensures a rf-tightness.

As is particularly shown in FIG. 2 which is a cross sectional view of the waveguide twist taken along the line II—II in FIG. 3 and thus illustrates the form-locking joint between the waveguide sections 1 and 2, it can be seen that the axial ends of the lever 6 are each provided with a pin 6a in form of a spherical head which engages in the groove 1*b*. After setting the twist angle $2\alpha$, the waveguide sections 1 and 3 are braced with each other by means of the bolts 9.

It will be appreciated that the levers 6 may be provided with lever arms of varying length to attain various twist angles between the individual waveguide sections 1, 2, 3.

In the embodiment of the waveguide twist in accordance with FIGS. 2 and 3, the waveguide sections 1, 2, 3 are galvanically contacted with each other.

Turning now to FIGS. 4 and 5, there is shown a second embodiment of a waveguide twist according to the invention and in correspondence to the principal design as described with reference to FIG. 1. The waveguide twist includes three waveguide sections 41, 42, 43 which are contacted via choke joints between the waveguide sections 41 and 42, on the one hand, and between waveguide sections 42 and 43, on the other hand. Each of both choke joints includes an annular slot s between adjoining waveguide sections and a groove S in one corresponding waveguide section e.g. waveguide section 41 and waveguide section 43. The annular slot s and the groove S define a $\lambda/2$-choke joint in correspondence to the principle of the short-circuit transformation.

Otherwise, the waveguide twist of FIGS. 4 and 5 corresponds to the waveguide twist as shown in FIGS. 2 and 3. Accordingly, the waveguide sections 41 and 43 are partly received in a housing 48 while waveguide section 42 is completely contained in the housing 48. A lever 46 is rotatably supported by bolt 47 at a central location of waveguide section 42 and, as shown in particular in FIG. 4 which depicts the connection between waveguide section 42 and waveguide section 41, is provided with axial ends 46*a* of spherical head shape which engage respective grooves 41*b and* 43*b* of the pertaining waveguide sections 41 and 43. The housing 48 extends externally between a flange 49 which is located at the upper end of the housing 48 and bears against the waveguide section 43 and a shoulder 41*c* of the waveguide section 41. By means of bolts 410, the housing 48 is secured to the waveguide sections 41 and 43 to brace and tighten the latter after setting the twist angle.

In the embodiment of FIGS. 2 and 3 and in the embodiment of FIGS. 4 and 5, three-staged waveguide twists are shown with the central waveguide section having a suitable electric length of approximately $\lambda/4$ of the waveguide wavelength.

Figure 6:
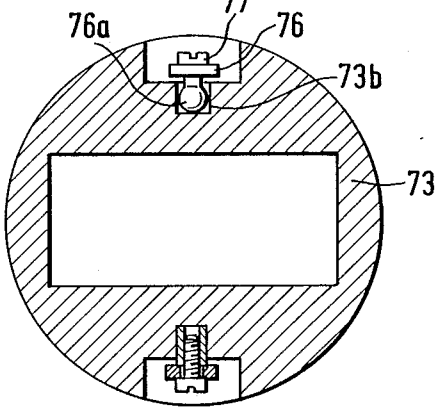
FIG. 6 is a simplified cross sectional view of a third embodiment of a waveguide twist according to the invention taken along the line VI—VI in FIG. 7.
Figure 7:
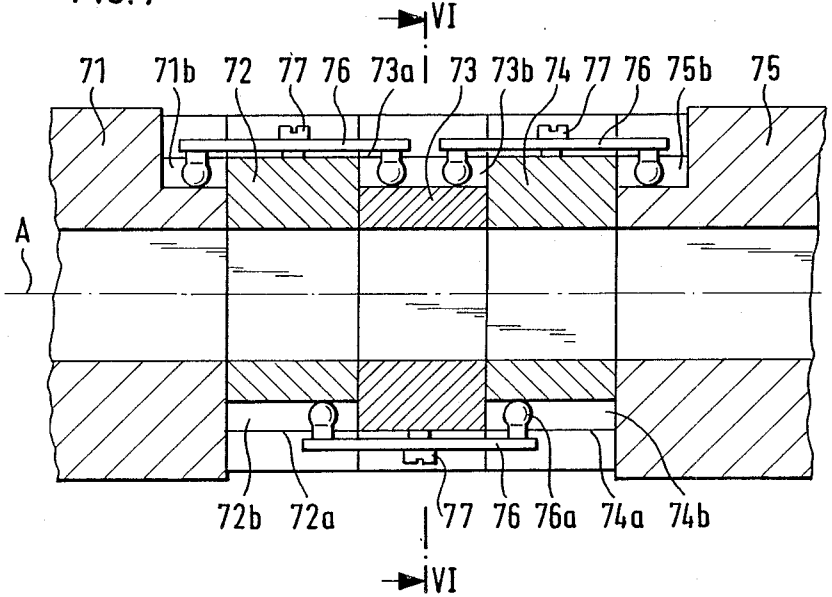
FIG. 7 is a longitudinal section of the waveguide twist of FIG. 6.

Referring now to FIGS. 6 and 7, there is shown a five-staged embodiment of a waveguide twist in accordance with the invention which allows a larger overall angle of rotation. For ease of illustration, the outer housing is not shown. The waveguide twist includes five waveguide sections 71, 72, 73, 74, 75, with the waveguide sections 71 and 75, on the one hand, and the waveguide sections 72, 73, 74, on the other hand, corresponding constructively with each other. However, the waveguide sections 72, 73, 74 are each offset to each other by 180°, and each of the waveguide sections 72, 73, 74 has a flat surface 72*a*, 73*a*, 74*a* which supports a rotatable lever 76 via a bolt 77. The levers 76 are each provided at their axial ends with spherical heads 76*a* which engage suitable grooves 71*b*, 72*b*, 73*b*, 74*b*, 75*b* of the waveguide sections 71, 72, 73, 74, 75. Thus, the ends of the lever engage grooves of adjoining waveguide sections so that upon setting the lever, the waveguide sections 71, 72, 73, 74, 75 can be rotated relative to each other by a same angle. The grooves 71*b*, 72*b*, 73*b*, 74*b*, 75*b* extend parallel to the longitudinal axis A of the waveguide twist.

It will be readily recognized that the number of stages is arbitrary without departing from the constructive principle of the invention. Assuming that the joint between the waveguide sections at a twist angle of $\alpha=0°$ does not cause an increase of the reflection factor, the latter is smaller with increasing number of stages at a given value of the twist angle $\alpha$.

While the invention has been illustrated and described as embodied in a Waveguide Twist, it is not intended to be limited to the details shown since various modifications and structural changes may be made without departing in any way from the spirit of the present invention.

What is claimed as new and desired to be protected by Letters Patent is set forth in the appended claims:

I claim:

1. A waveguide twist; comprising:

a plurality of waveguide sections, the number of which being at least three, said waveguide sections defining a longitudinal axis and including a first waveguide section and a last waveguide section and being arranged in succession from said first waveguide section to said last waveguide section; and lever means for allowing said waveguide sections to be rotated relative to each other, said lever means including a lever externally supported on each of said waveguide sections arranged between said first waveguide section and said last waveguide section and being rotatable about an axis perpendicular to said longitudinal axis, said lever having two axial ends engaging in a groove of adjoining waveguide sections for longitudinal displacement, with said groove extending parallel to said longitudinal axis.

2. A waveguide twist as defined in claim 1 with more than three waveguide sections, wherein said levers of successive waveguide sections are offset to each other by 180° relative to said longitudinal axis.

3. A waveguide twist as defined in claim 1 wherein said lever means further comprises a bolt arranged on said waveguide sections perpendicular to said longitudinal axis, said lever being rotatably supported by said bolt.

4. A waveguide twist as defined in claim 1 wherein said axial ends of said lever are each defined by a pin in form of a guide head engaging in said grooves of adjoining waveguide sections.

5. A waveguide twist as defined in claim 4 wherein said guide head is a spherical head.

6. A waveguide twist as defined in claim 1, and further comprising fastening means for bracing said first waveguide section with said last waveguide section.

7. A waveguide twist as defined in claim 6 wherein said fastening means includes screws traversing said first and last waveguide sections.

8. A waveguide twist as defined in claim 1, and further comprising choke joints for contacting said waveguide sections with each other.

9. A waveguide twist as defined in claim 1 wherein each of said waveguide sections is of essentially cylindrical shape with a flat-surfaced area upon which said lever and said groove are provided.

10. A waveguide twist as defined in claim 1, and further comprising a housing for receiving said waveguide sections, said housing serving as rotational support for said waveguide sections.

11. A waveguide twist as defined in claim 1 wherein said lever means has exchangeable lever arms to allow variations of the length thereof for attaining various angles of twist between said waveguide sections.

12. A waveguide twist as defined in claim 1 wherein said waveguide sections between said first and last waveguide sections define an electric length, said electric length being variable by altering the length of said waveguide sections so as to allow an increase of the band width within which the reflection factor remains below a preset value.

13. A waveguide twist as defined in claim 7 wherein said first waveguide section includes an outwardly directed shoulder and said last waveguide section includes an outwardly directed shoulder, said fastening means including a flange bearing against said shoulder of said first waveguide section, said screws traversing said flange and said shoulder of said last waveguide section to brace said first waveguide section with said last waveguide section.

* * * * *